US007261277B2

(12) United States Patent
Copeman

(10) Patent No.: US 7,261,277 B2
(45) Date of Patent: Aug. 28, 2007

(54) WINCHES

(75) Inventor: Darrell Ballantyne Copeman, Ballina (AU)

(73) Assignee: Varsitor Corporation Pty Ltd, Brisbane, Queensland (AU)

( * ) Notice: Subject to any disclaimer, the term of this patent is extended or adjusted under 35 U.S.C. 154(b) by 0 days.

(21) Appl. No.: 10/531,471

(22) PCT Filed: Oct. 16, 2003

(86) PCT No.: PCT/AU03/01360

§ 371 (c)(1),
(2), (4) Date: Dec. 7, 2005

(87) PCT Pub. No.: WO2004/035456

PCT Pub. Date: Apr. 29, 2004

(65) Prior Publication Data

US 2006/0097236 A1 May 11, 2006

(30) Foreign Application Priority Data

Oct. 16, 2002 (AU) ..... 2002952079

(51) Int. Cl.
*B66D 1/08* (2006.01)

(52) U.S. Cl. ..... 254/323; 254/328; 254/367

(58) Field of Classification Search ..... 254/323, 254/328, 330, 365, 367, 368
See application file for complete search history.

(56) References Cited

U.S. PATENT DOCUMENTS 4,162,713 A * 7/1979 Heitman et al. ..... 180/242
4,185,520 A * 1/1980 Henneman et al. ..... 475/83
4,337,926 A * 7/1982 Dehaan ..... 254/365
4,358,088 A * 11/1982 House et al. ..... 254/349
4,372,535 A * 2/1983 Gibson et al. ..... 254/319
5,398,911 A * 3/1995 Holster ..... 254/267
5,692,735 A * 12/1997 Aho et al. ..... 254/323
5,794,920 A * 8/1998 Kronberger ..... 254/361
5,842,684 A * 12/1998 Aho ..... 254/344
6,095,500 A * 8/2000 McVaugh ..... 254/361
6,164,627 A * 12/2000 Ravellini ..... 254/361
6,276,449 B1 * 8/2001 Newman ..... 166/53
6,371,447 B1 4/2002 Imanishi et al.
6,523,806 B2 * 2/2003 Bartal ..... 254/323
7,028,989 B2 * 4/2006 Flynn et al. ..... 254/323

FOREIGN PATENT DOCUMENTS

| | | |
|---|---|---|
| AU | 200116345 | 7/2001 |
| JP | 9240991 | 9/1997 |
| WO | WO99/32390 | 7/1999 |

* cited by examiner

*Primary Examiner*—Emmanuel M Marcelo
(74) *Attorney, Agent, or Firm*—Shoemaker and Mattare

(57) ABSTRACT

A winch assembly (38) comprising a winch (10) having a winch spool (23), an hydraulic drive motor (15), a clutch (17) for directly coupling the drive motor (15) to the winch spool (23) to effect rotation of the winch spool (23) by the drive motor (15), an hydraulic power pack (39) having an hydraulic pump (40) driven by an electric motor (42) for supplying hydraulic fluid to the winch drive motor (15) via a valve assembly (45) and a controller (43) for controlling operation of the hydraulic power pack (39) and the valve assembly (45) to control the supply of hydraulic fluid from the hydraulic power pack (39) to the winch drive motor (15).

23 Claims, 6 Drawing Sheets

30
31
35
36
32
15
16
20
12
14
26
33
27
28
23
24
13
22
25
21
11
X

WINCHES

TECHNICAL FIELD

This invention relates to winches and in particular to winches which are suited to use in or on vehicles but which have many other applications.

BACKGROUND ART

Winches of many different configurations are known. For use in vehicles, for example to assist a vehicle which has become bogged or for emergency service vehicles, winches are mounted on or adjacent the forward bumper or bull bar and have ranged from the older style capstan winches having a vertical spool, to power takeoff winches and hydraulic winches run off the vehicle gearbox. More recently, electric winches which have an electric motor driven from the vehicle battery have become a preferred winch for use on vehicles. Another form of known winch is an hydraulic winch which uses the vehicles own power steering fluid as the source of fluid to drive the hydraulic motor of the winch.

A major disadvantage of the common electric winches is that the current drain on the vehicle battery can be very high during winch operation. For example, electric winches can draw a current in the order of 500 amps which obviously places a considerable load on a normal vehicle battery which may be only rated at 70 amp/hour. As a result the known electrical winches can only be used for a short period of time before the vehicle battery becomes completely drained. A further disadvantage of electric winches is that they cannot operate underwater or in mud.

The known hydraulic winches also suffer a number of disadvantages in that they tend to require a large quantity of hydraulic fluid for their operation and furthermore they tend to heat up rapidly when subject to a load. They also have limited line speed.

SUMMARY OF THE INVENTION

The present invention aims to provide an improved winch and winch assembly which is particularly but not exclusively suited to use on in connection with vehicles such as four-wheel drive vehicles or emergency service vehicles. The winch and winch assembly of the present invention however may be used in many other applications. Other objects and advantages of the invention will become apparent from the following description. The present invention thus provides a winch assembly including a winch spool, an hydraulic drive motor, means for coupling said drive motor to said winch spool whereby to effect rotation of said winch spool by said drive motor, hydraulic supply means for supplying hydraulic fluid to said drive motor, and control means for controlling the supply of hydraulic fluid from said hydraulic supply means to said hydraulic motor.

Preferably, the hydraulic supply means in one form comprises an hydraulic pump and the control means includes means for controlling operation of the pump. Suitably the hydraulic pump is driven by an electric drive motor and the control means is operative to control the connection of the pump motor to a power supply. Preferably the electric drive motor comprises a low voltage DC drive motor whereby current supply for the drive motor can be provided by a battery or batteries.

Preferably, control valve means connects the hydraulic pump and hydraulic motor of the winch and the control means includes means for controlling operation of the valve means. Preferably, the control means is adapted to cause operation of the valve means slightly prior to operation of the hydraulic pump to prevent hydraulic lock-up in the system. This may be achieved by providing time delay means which delay the supply of current from the power supply to the pump motor. The valve means suitably comprises a solenoid-operated valve. The valve means is suitably incorporated in or associated with a manifold block supplied by the hydraulic pump. The manifold block may include a plurality of auxiliary hydraulic outlets controlled by respective hydraulic valves, suitably solenoid control valves, for connection to other hydraulic accessories.

The control means may include manually operable means such as switches for controlling supply of current from the power supply to the pump motor and to the solenoid valve. The control means thus controls operation of the winch by controlling operation of the hydraulic pump and the valve which controls supply of fluid from the pump to the motor. Most preferably, the control means also includes a remote control unit for remotely controlling operation of the switch means. The remote control unit thus allows cordless remote control of operation of the winch and/or auxiliary hydraulic outlets. The switches may include relay switches within the control means which are actuated by externally actuable manually operated switches or the remote control unit.

In a further form, the hydraulic pump may be belt driven from the vehicle engine or from a power take off and the control means is operable to control supply from the outlet of the hydraulic pump.

Preferably the coupling means between the winch drive motor and winch spool prevents disengagement of the drive motor from the winch spool when the winch is subject to a load.

Preferably, the coupling means between the winch and drive motor comprises a clutch which when actuated directly couples the motor to the spool to effect rotation of the spool. The clutch further prevents disengagement of the drive motor from the winch spool when the winch is subject to a load. The winch may be subject to a load when a winch cable wound on the winch spool is carrying a load either when the winch is winding in the spool and thus winding in the cable or letting out the cable. The winch may also be subject to a load when not driving the spool for example where the winch cable is still attached to a load. Preferably, clutch actuating means are provided for actuating the clutch, the clutch actuating means being and remaining actuated when the winch is subject to a load.

Preferably, the clutch comprises a dog clutch having complementary clutch members connected to the motor and spool respectively, the clutch members when engaged transmitting rotation directly between the drive shaft of the motor and spool. Preferably, the spool is mounted for movement axially of the motor to effect engagement of the clutch members or disengagement of the clutch members. The complementary clutch members suitably comprise at least one pin or dog and a least one complementary aperture for receiving the at least one pin or dog. The at least one pin or dog is suitably provided on a drive plate coupled to the motor and the at least one aperture is suitably provided on a driven plate connected to or forming part of the spool. Most suitably, a plurality of axially extending pins or dogs are provided arranged at a common radius on the drive plate and at a circumferential spacing and the driven plate includes a corresponding number of apertures arranged on a similar radius and circumferential spacing on the driven plate.

Suitably, the clutch actuating means is operative to move the spool axially to effect engagement of the clutch members. The spool for this purpose may have a hollow central body extending axially of the spool and mounted at each end on bosses which support the spool for rotation and further allow for limited axial movement of the spool. Preferably, means are provided for causing operation of the clutch actuating means when fluid is supplied from the pump to the winch drive motor whereby the clutch is engaged automatically. If the at least one pin or dog is not aligned with the at least one aperture, relative rotational movement between the pin or dog and aperture as caused by operation of the winch drive motor will cause the pin or dog and aperture to become aligned and thereafter urged into engagement with each other by the actuating means.

Preferably, means are provided to cause operation of the clutch actuating means when hydraulic fluid is supplied to the hydraulic winch motor from the pump such as to cause engagement of the winch spool with the drive motor through the clutch. Preferably the actuating means comprises an hydraulic actuator suitably a one way fluid actuator. Suitably the actuator is connected to hydraulic supply lines to said motor whereby hydraulic fluid is supplied to the hydraulic actuating means when hydraulic fluid is supplied to the hydraulic motor to drive the winch spool. For this purpose a hydraulic supply line to the hydraulic actuating means is connected to the supply lines to the hydraulic drive motor whereby fluid is supplied to the actuating means irrespective of the direction of motion of the drive motor. Manual means may be provided to release the clutch actuating means when fluid supply is removed from the motor or load is removed from the winch.

Further valve means may also be provided between the control valve means and winch motor. Suitably, the further valve means is contained in a manifold mounted to or adjacent the winch motor. Most preferably, the further valve means controls the supply of fluid from the pump to the winch motor and exhaustion of fluid from the motor to thereby delay operation of the motor after operation of the control valve means to prevent hydraulic lock up in the hydraulic circuit.

Braking means may be associated with the winch drive motor, the braking means being operative to brake the motor and thus prevent spool rotation when the motor is not supplied with fluid and is thus not operating. Preferably, the braking means comprises a negative pressure disc braking means which is released when fluid pressure is supplied to the motor to cause operation thereof but which is automatically applied when fluid pressure is removed from the motor.

The winch described above is particularly suited to use in combination with a hydraulic power pack. The winch however may also be used with other hydraulic pressure sources. Further the principles of the winch may also be applied to other forms of winch and drive motor. Accordingly, the present invention in a further aspect provides a winch having a winch spool, a drive motor, coupling means for coupling said drive motor to said winch spool to effect rotation of said spool and means for preventing disengagement of said drive motor from said winch spool when said winch is subject to a load. Preferably, the means for preventing disengagement of the drive motor from the winch spool comprises actuating means for effecting coupling between the drive motor and winch spool, the actuating means preventing the aforesaid disengagement when the winch is subject to a load. The actuating means is suitably actuable to actuate a clutch to couple the drive motor and winch spool.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE PREFERRED EMBODIMENT

Figure 1:
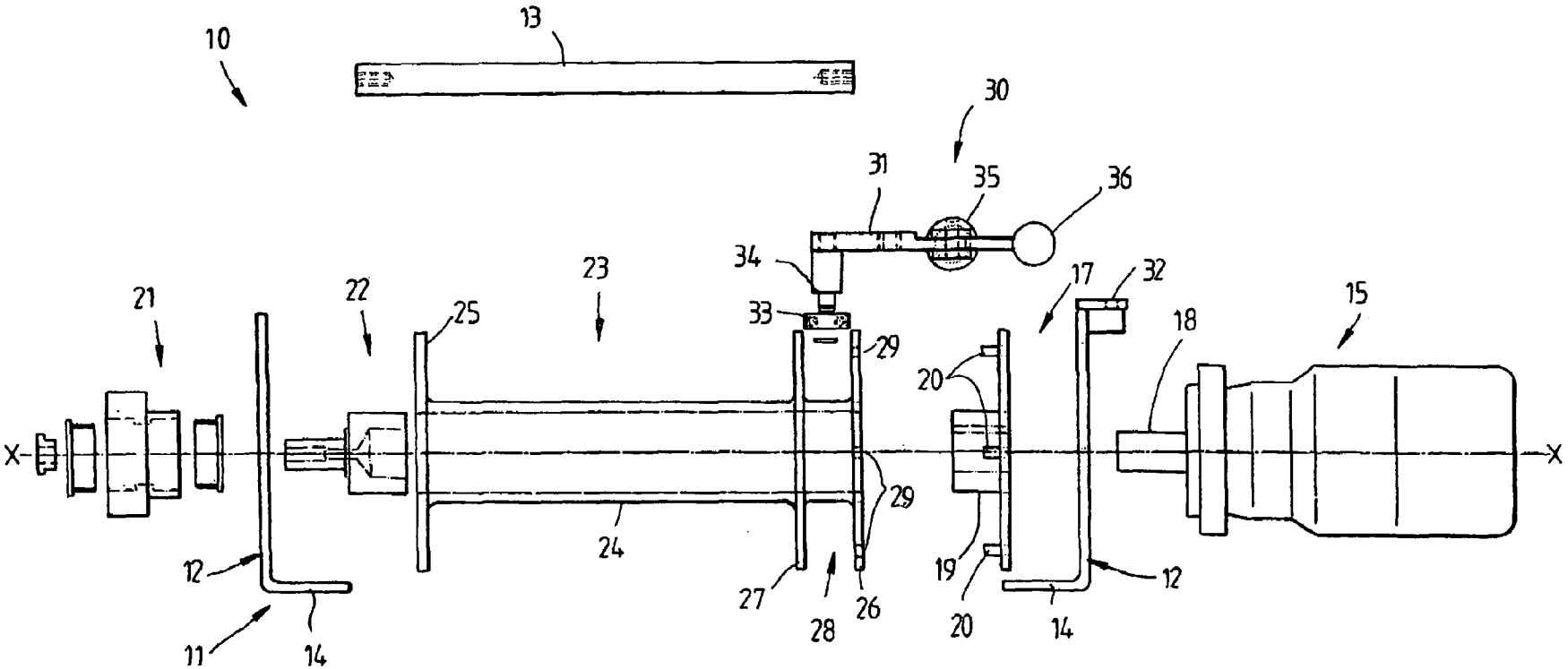
FIG. 1 is an exploded side view of the winch of the winch assembly according to an embodiment of the present invention.

Referring to the drawings and firstly to FIGS. 1 to 4, there is illustrated a winch 10 for use in the winch assembly according to an embodiment of the present invention which includes a support frame 11 comprising a pair of end frame members 12 spaced apart by and joined to opposite ends of spacer bars 13. The frame members 12 have flanges 14 which enable mounting of the winch 10 as required such as to a standard winch base bolt mounting. An hydraulic motor 15 is mounted to one of the frame members 12 and a drive plate 16 of a dog clutch 17 is keyed to the drive shaft 18 of the hydraulic motor 18, the drive plate 16 having a central boss 19 and in instance four driving pins or dogs 20 which extend in an axial direction and are arranged at a common radius from the axis X—X of rotation of the drive plate 16 and at equal circumferential spacing around the drive plate 16. A bearing assembly 21 is provided on the other end frame member 12 and rotatably supports a stub axle 22. Both the boss 19 of the drive plate 16 and stub axle 22 have the same external diameter.

The winch spool 23 includes a main hollow cylindrical spool body 24 which is supported at opposite ends by the boss 19 and stub axle 22 respectively, the body 24 having an internal diameter substantially the same as the external diameter of the boss 19 and axle 22. The winch spool 23 is thus supported for rotation about the axis X—X. Further the spool 23 is capable of limited longitudinal or axial movement along the axis X—X for a purpose which will hereinafter become apparent.

Annular end plates 25 and 26 are fixed at opposite ends to the spool body 24 and in addition, the spool body 24 carries a further annular plate 27 spaced inwardly from the plate 26 and defining therewith an annular channel 28. The end plate 26 also includes four spaced apertures 29 arranged at the same radius as the pins 20 and at the same circumferential spacing, the apertures 29 having an internal diameter substantially the same as the external diameter of the pins 20. The pins 20 mounted on the plate 16 and apertures 29 in the end plate 26 form the dog clutch 17 for transmitting drive directly from the hydraulic drive motor 15 to the spool 23 as described further below.

The support frame 11 also carries a clutch actuator assembly 30 which includes a lever arm 31 mounted at 32 to the frame member 12 which supports the motor 15 for pivotal movement about an axis extending substantially normal to the axis X—X of rotation of the spool 23. A bearing wheel 33 is mounted at one end of the arm 31 on an axle 34 and is located in the channel 28 to bear on the respective plates 26 and 27. The opposite end of the arm 31 is connected to a one-way hydraulic actuator 35 The arm 31 also extends beyond the mounting 32 and terminates in a manual release knob 36 which in the absence of hydraulic pressure applied to the actuator 35 or load on the winch 10 enables manual movement of the winch spool 23 in opposite directions along the axis X—X to engage or disengage the clutch 17.

Figure 4:
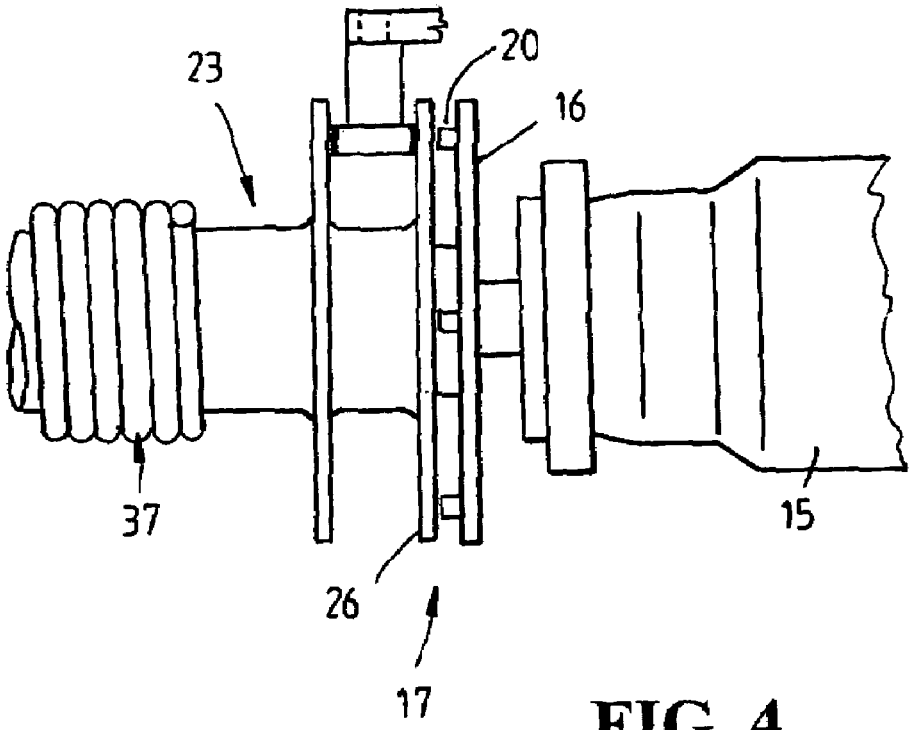
FIG. 4 is a side elevation of the clutch at one end of the winch spool in a disengaged position

In the disengaged position of the clutch 17 as shown in FIG. 4, the spool 23 is capable of free wheeling such that cable 37 wound on the spool 23 may be unwound so as to enable it to be coupled to a load or anchoring point. When hydraulic fluid under pressure is supplied to the winch motor 15, the hydraulic motor 15 will be actuated causing rotation of the shaft 18 and drive plate 16. At the same time, fluid pressure applied to the clutch actuator 35 will cause the actuator 35 to apply a pivoting force to the lever arm 31 which causes through the bearing wheel 33 acting on the spool end plate 26, an axial force to be applied to the end plate 26 to urge it towards the drive plate 16 so that it abuts the ends of the pins 20. The frictional force between the ends of the pins 20 and the plate 16 will cause the spool 23 to rotate and wind in the cable 37. When however the load is taken up and tension begins to be applied to the cable 37, the plate 26 will slip and rotate relative to the plate 16 as the clutch 17 is not engaged. Relative rotation between the plates 26 and 16 will move the pins 20 on the plate 16 into alignment with the respective apertures 29 in the plate 26 at which position, the pins 20 will locate in the apertures 29 with the plate 26 and spool 23 being urged axially along the axis X—X by the actuator 35 towards the motor 15. Drive will thus be transmitted directly from the motor 15 to the spool 23 and effect positive rotation of the spool 23 and winding in of the cable 37.

If the pins 20 are aligned with the apertures 28 when fluid pressure is applied to the actuator 35, the clutch 17 will be immediately engaged however in most cases, this will not occur. As described further below, if fluid pressure remains applied to the motor 15, the clutch 17 cannot be disengaged. Similarly, whilst the load remains on the winch 10 through the winch cable 37, the clutch 17 cannot be disengaged without taking the load from the cable 37 due to the frictional engagement between the clutch pins 20 and apertures 29. Thus there is no risk of inadvertent release of the cable 37 and load.

Figure 5:
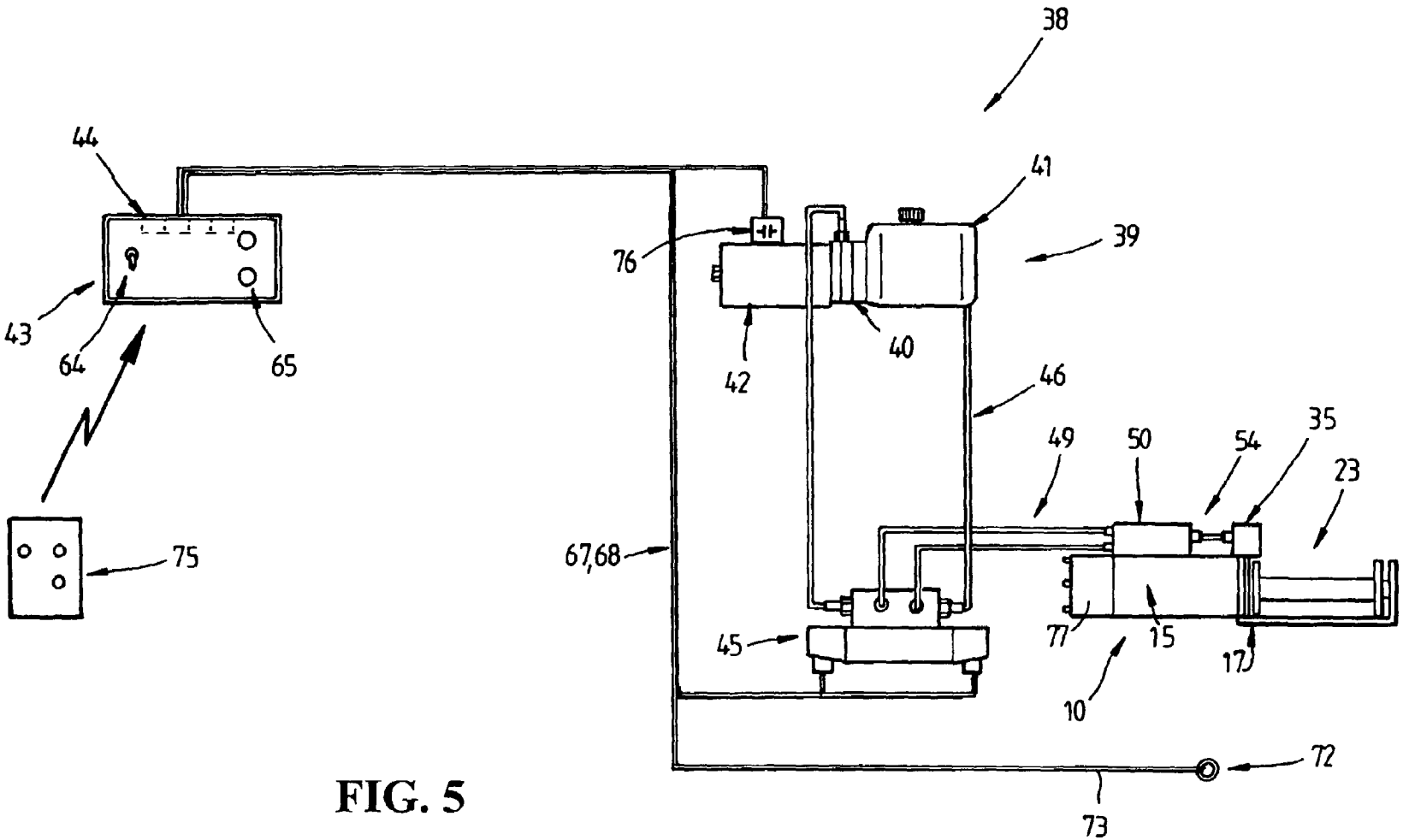
FIG. 5 illustrates the general configuration of the winch assembly incorporating the winch of FIGS. 1 to 4.

The winch 10 is typically used in a winch assembly 38 including a hydraulic fluid supply in the form of a hydraulic power pack 39 which includes a hydraulic pump 40 associated with an hydraulic fluid reservoir 41 and an electric drive motor 42 coupled to the pump 40 as shown in FIG. 5. The drive motor 42 typically is a 12V or 24V DC motor which may be driven from a battery or batteries typically a battery or batteries of a vehicle under the control of a control unit 43 and via relays 44 within the control unit 43.

A valve assembly 45 connected to the pump 40 and it associated reservoir 41 controls the supply of hydraulic fluid from the pump 40 to the winch motor 15 at a regulated pressure and flow and from the motor 15 back to the pump reservoir 41 through hydraulic lines 46. The valve assembly 45 is associated with a manifold block 47 (shown schematically in FIG. 6) which may also be associated with one or more further solenoid valve assemblies 48. Each solenoid valve assembly 45 and 48 is connected to the pump 40 indicated schematically by port P and to the hydraulic reservoir 41 indicated schematically by port T. The valve assembly 45 is also connected to outlet ports indicated schematically as A2 and B2. The further solenoid valve assembly 48 can be actuated to supply fluid to auxiliary devices such as hydraulic jacks or hydraulic power tools through outlets indicated schematically as A3 or B3. Any number of valves 48 may be provided for supplying different auxiliary devices. Pilot valves PV may be provided in the auxiliary circuits to prevent creep with single action rams.

Figure 7:
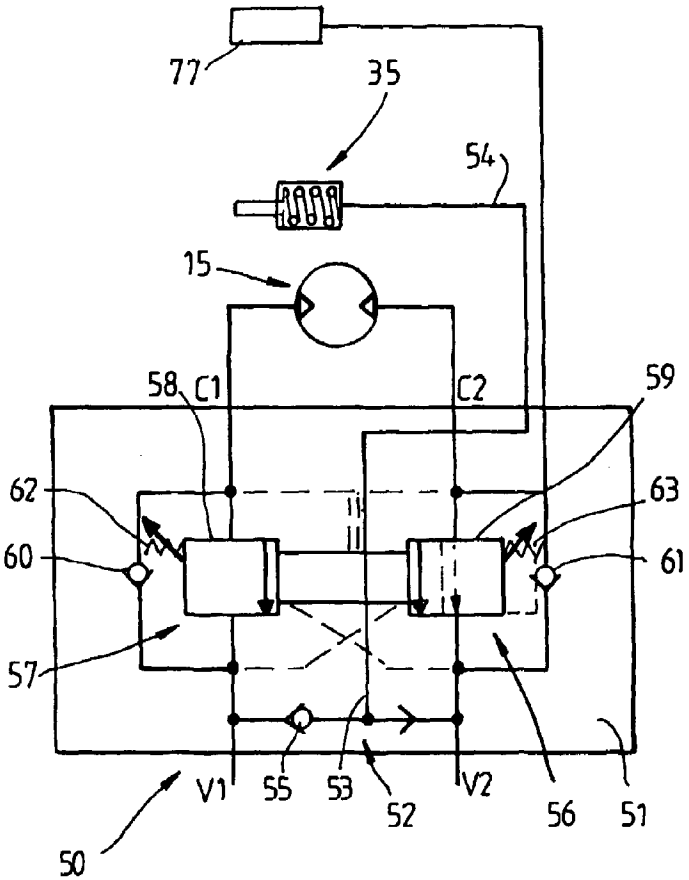
FIG. 7 illustrates the winch hydraulic circuit.

The ports A2 and B2 are connected by hydraulic lines 49 (see FIG. 5) to respective ports indicated schematically as V1 and V2 to the motor valve assembly 50 which includes manifold block 51 (see FIG. 7). Outlet ports C1 and C2 indicated schematically are connected to the winch motor 15. The valve assembly 50 includes a one-way ball shuttle valve 52 connected between the ports V1 and V2. A passageway 53 within the manifold block 52 is connected to the shuttle valve 52 and via hydraulic line 54 to the hydraulic clutch actuator 35. Fluid pressure applied to either inlet V1 or V2 will be applied via the one-way ball shuttle valve 52 through passage 53 and line 54 to the clutch actuator 35 to maintain clutch engagement irrespective of the direction of rotation of the motor 15 and winch spool 23. In the position of FIG. 7, fluid pressure is applied to port V2 to cause the ball 55 of the shuttle valve 52 to move to the left in FIG. 7 and thereby open communication between the port V2 and passage 53 but prevent communication between ports V1 and V2. Similarly if fluid pressure is applied to the port V1, the ball 55 of the shuttle valve 52 will reposition to the right in FIG. 7 opening communication between the port V1, passage 53 and line 54.

The valve assembly 50 further includes a fluid actuable valve 56 which includes a piston-like valve member 57, opposite ends 58 and 59 of which control communication between ports V1 and C1 and ports V2 and C2 respectively and normally block this communication to act as a fluid brake to the motor 15. One-way valves 60 and 61 connect ports V1 and C1, and V2 and C2 respectively and are arranged in parallel with the valve members 58 and 59. Opposite ends of the valve member 57 are connected at 62 and 63 to the downstream sides of the one-way valves 60 and 61 for fluid actuation of the valve member 57.

Figure 6:
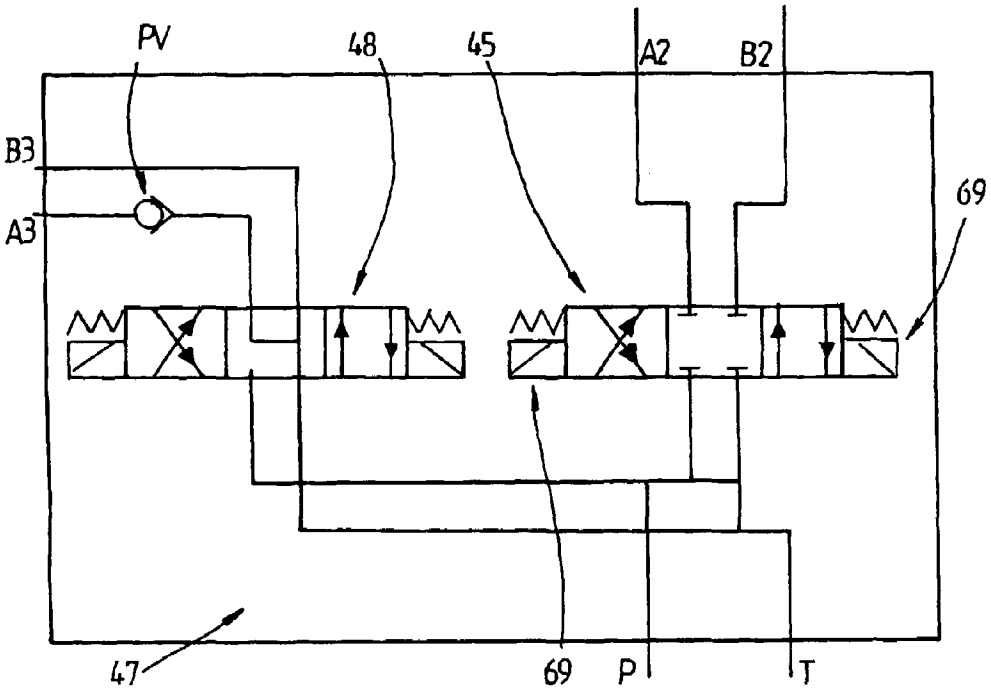
FIG. 6 illustrates schematically, the main control valve manifold for controlling fluid supply to the winch motor.

Assuming that the valve 45 is actuated to the left of its position shown in FIG. 6, the valve 45 opens communication to the pump port P and reservoir port T such that hydraulic fluid is supplied to port V1 from pump 40 and port V2 is connected to the reservoir or tank 41. Fluid will flow through the one way valve 60 to the port C1 and also be applied to the left hand end of the valve member 57 to cause the valve member 57 to move to the right of its position shown in FIG. 7. The end 59 of the valve member 57 will thus open communication between the ports V2 and C2 as shown in dotted outline. Thus one port of the motor 15 is connected to the fluid supply through port V1 and the other port of the motor 15 is connected through port V2 to the reservoir 41 thereby causing the motor shaft 18 to be driven in a first direction for example to wind in the winch cable 37. The operation of the valve 56 ensures that there is a small time delay however before the motor 15 can commence operation so as to prevent any hydraulic lockup in the system. Fluid pressure applied to the port V1 is also applied to the actuator 35 through the shuttle valve 52 to thereby effect actuation of the clutch 17 and drive to be transmitted to the winch spool 23 in the manner described above. When the spool 23 is to be driven in the opposite direction, for example to wind out the winch cable 37, the port V1 is connected to the reservoir 41 and the port V2 to the fluid supply of the pump 40 through actuation of the solenoid actuated valve 45 in the opposition direction. In this case the valve member 57 is moves to the left of its position in FIG. 7 to connect the motor 15 to the fluid supply and reservoir with again the valve 56 introducing a small time delay before the motor 15 can operate. The further passages in the valve manifold 51 shown in dotted outline in FIG. 7 are bleed passages provided to damp movement of the valve member 57 to prevent shock loadings on the member 57.

Figure 8:
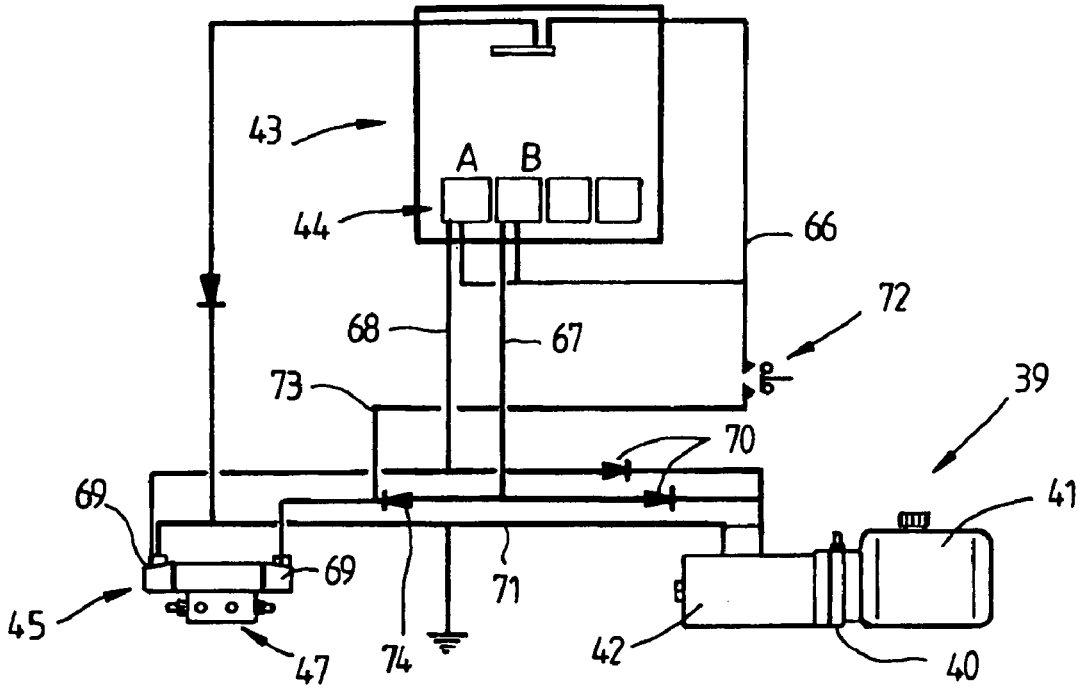
FIG. 8 illustrates the basic electrical wiring circuit for control of the winch assembly.

FIG. 8 illustrates the electrical circuit by which the control unit 43 is connected to the solenoid actuated valve 45 and pump motor 42. The control unit 43 includes an on-off switch 64 (see FIG. 5) which when actuated connects or disconnects the controls unit 43 to or from the power supply such as the vehicle batteries. The control unit 43 also includes a pair of hard wired "IN" or "OUT" switches 65 which when actuated cause switching of the relays 44 and current to be supplied to the motor 42 of the hydraulic power pack 11 and also actuation of the solenoid actuators of the valve assembly 45 for supply of hydraulic fluid to the winch motor 15 via the valve assembly 50 either to cause the winch spool 23 to rotate in a first direction to wind in the winch cable 37 or rotate in the opposite direction to allow the winch cable 37 to be wound out from the winch spool 22.

As shown in FIG. 8, wire 66 which is a supply wire connects the switches of the relays 44A and 44B to supply. The other switch terminals of the relays 44A and 44B are connected by wires 67 and 68 to opposite solenoid actuators 69 of the solenoid valve 45. The wire 67 and 68 are also connected through diodes 70 to the pump motor 42. Wires 71 are earth wires connected to the solenoid actuators 69, pump motor 42 and controller 43. A pressure dump switch 72 is connected to the supply wire 66 and via wire 73 to one of the solenoid actuators 69. A diode 74 isolates the operation of the switch 72 from the pump motor 42. The switch 72 is usually mounted in a position adjacent to the winch 10. The other relays 44 shown may be used for switching the auxiliary valves 48.

When the relay 44A is actuated by one of the switches 65, power is supplied to one solenoid actuator 69 of the valve 45 and through a diode 70 to the pump motor 42 to thereby cause operation of the pump 40 and move the valve 45 in one direction. Similarly actuation of the relay 44B will supply power to the other solenoid actuator 69 of the valve 45 and to the pump motor 42 to move the valve 45 in the opposite direction and also initiate pump operation. This therefore can effect rotation of the winch motor 15 in opposite directions. The control unit 43 may also be controlled by a wireless remote control unit 75 and for this purpose the control unit 43 includes a receiver to receive signals from the control unit 75 and cause switching of the relays 44 in the same manner as if manually controlled. Manual operation of the control unit switches 65 however overrides operation of the remote control unit 75. The auxiliary valves 48 may also be actuated by the remote control unit 75 or alternatively or additionally by hard wired switches.

As stated above, to prevent hydraulic lock up when the control unit 43 is activated by operation of remote controller 75 or manually operated switches 65, the solenoid valve assembly 45 is caused to be actuated slightly prior to fluid being supplied to the motor 15 as effected by the valve 56. A further alternative or additional means to prevent hydraulic lock up is to ensure that the pump 42 does not commence operation until the valve assembly 45 is actuated. This can be achieved electrically by momentarily delaying operation of the pump motor 42 by introducing a time delay in the power supply to the pump motor 42. This time delay may be achieved by a suitable time delay circuit in the control unit 43 or by software control. In a simplified form, the time delay is achieved by the use of a capacitor 76 (shown schematically in FIG. 5) in series with the electrical supply line to the pump motor 42. The capacitor 76 may be located within the control unit 43.

In the disengaged position of the clutch 17 as shown in FIG. 4, the spool 23 is capable of free wheeling such that cable 37 wound on the spool 23 may be unwound so as to enable it to be coupled to a load or anchoring point. When the control unit 43 is operated either manually by the switches 65 or by the remote control unit 75, current is supplied to the pump motor 42 and solenoid valve assembly 45 to cause hydraulic fluid under pressure to be supplied from the pump 40 to the motor 15 through the valve assembly 50. The hydraulic motor 15 will thus be actuated causing rotation of the shaft 18 and drive plate 26. At the same time, fluid pressure is applied through the valve assembly 50 to the clutch actuator 35 to engage the clutch 17 and couple the motor 15 directly to the spool 23 as described above to cause rotation of the spool 23.

Whilst the fluid pressure remains applied to the valve assembly 50 from the pump 40, the clutch 17 cannot be disengaged as fluid pressure remains applied to the actuator 35. Further, whilst the load remains on the winch 10 through the winch cable 37, the clutch 17 cannot be disengaged without taking the load from the cable 37 as the spool 23 cannot be moved axially away from the clutch drive plate 16 due to the frictional engagement between the clutch dogs or pins 20 and apertures 29.

After load is removed from the winch cable 37 and after the winch motor 15 ceases operation, the clutch 17 may be manually disengaged by force applied to the handle 46 of the lever 31 (a clockwise force in FIG. 3) which forces fluid from the actuator 35 through the line 54 and moves the spool 23 to the clutch disengage position of FIG. 4 so that the spool 23 may be freely rotated. Fluid pressure in the actuator supply line 34 can be relieved by reversing the motor 15 to allow release of the clutch 17 by the lever 31.

To prevent hydraulic overload due to excessive loading on the winch 10, the pump 40 may be provided with a pressure relief valve so as to relieve excess pressures and direct hydraulic fluid to the reservoir 41 to thereby prevent winch overload.

The hydraulic motor 15 of the winch 10 may also include a negative pressure disc brake 77 (see FIGS. 5 and 7) connected to the actuator supply line 54 to prevent motor creep. The brake 77 will be released at any time that fluid is applied to motor 15 via connections C1 or C2. Where there is no fluid pressure at connection C1 or C2, the brake will be applied to prevent rotation of the motor shaft 18 and maintain the shaft locked against rotation thereby eliminating possible creep due to hydraulic pressure losses. The brake 77 may also be released by reversing the hydraulic motor 15 by the fluid pressure applied to the motor 15.

The winch 10 being hydraulically driven may be used in underwater situations in water or in mud for extended periods of time as all electrical components are associated with the hydraulic power pack 41 or positioned remotely from the winch 10. The use of the remote controller 75 allows the operator to work away from the danger zone of winch cable 37 or vehicle being winched. This is further facilitated by using the winch cable 37 as an aerial extension for receipt of control signals from the controller 75, the control unit 43 being configured such that its receiving aerial is formed by the body of the winch 10 and connected winch cable 37. As operation of the winch 10 automatically engages the clutch 17, the operator is not required to return to the winch 10 to commence operation.

If it is necessary to dump pressure from the system to allow manual disengagement of the clutch 17, the pressure dump switch 72 may be actuated which applies current to one of the valve solenoids 67 through the line 73 however the diode 74 prevents current supply to the pump motor 42. Fluid will thus be dumped back to the reservoir 41 to relieve fluid pressure in the system. The negative pressure brake 77 will lock the motor shaft 18 against rotation however the clutch 17 can be manually disengaged by means of manual operation of the lever arm 31 whilst the switch 72 remains actuated to allow the spool 23 to free wheel if desired.

Figures 2, 3:
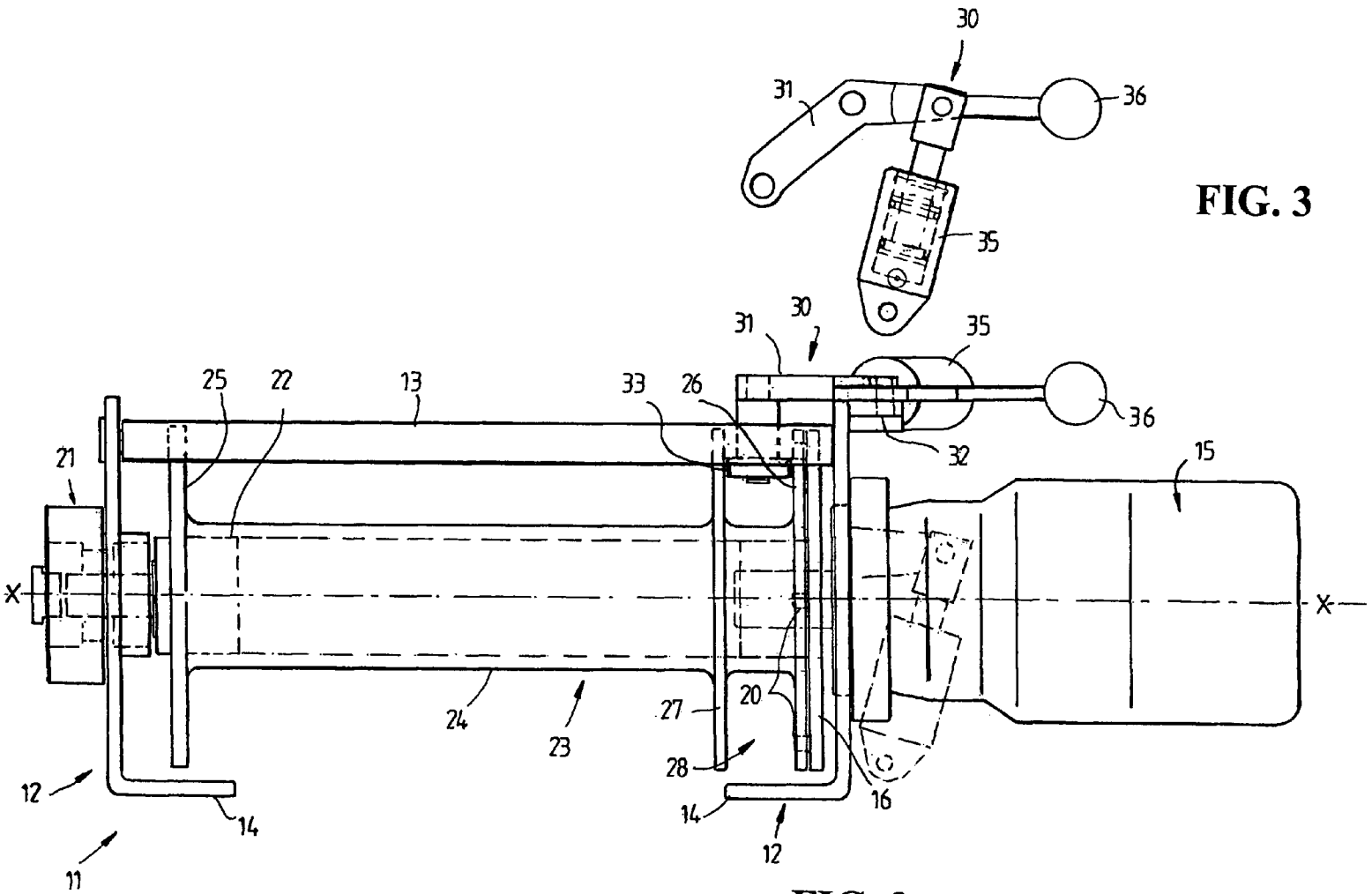
FIG. 2 is a side elevation of the winch in an engaged position with the winch spool.
FIG. 3 illustrates the clutch actuator of the winch in plan view.

The actuator assembly 35 may be mounted at other positions on the frame 11 as shown in dotted outline in FIG. 2 and as an alternative may be mounted at the opposite end of the winch 10 with in this case the plate 27 being located adjacent the end plate 25 to define therewith the channel 28 for receipt of the bearing wheel 33. The actuator assembly 30 may of course be in many different configurations other than that described and illustrated to effect movement of the spool 23 axially for clutch engagement.

here the winch assembly 38 is to be mounted on a vehicle, the control unit 43 is usually located at an accessible position with the vehicle cab for example beneath or on the vehicle dashboard whilst the valve 45 and associated manifold 47 can be located in a protection position such as in the vehicle engine bay. The winch 10 may be mounted at a convenient position on a vehicle however normally is located at the front of the vehicle. The winch 10 however may be positioned at the rear of the vehicle. The winch assembly 38 whilst particularly suited to use with vehicles, it may be used in many different application such as in marine environments where the winch 10 can be exposed to moisture.

The term "comprising" or "comprises" or derivations thereof as used throughout the specification are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as defined in the appended claims.

The invention claimed is:

1. A winch assembly comprising:

a winch spool, an hydraulic drive motor, hydraulically actuable coupling means for coupling said hydraulic drive motor to said winch spool whereby said winch spool may be rotatably driven by said hydraulic drive motor, hydraulic fluid supply means, and control means for controlling the supply of hydraulic fluid from said hydraulic fluid supply means to said hydraulic motor and said hydraulically actuable coupling means to control operation of said hydraulic drive motor and the coupling of said hydraulic drive motor to said winch spool.

2. A winch assembly comprising:

a winch spool, an hydraulic drive motor, coupling means for coupling said drive motor to said winch spool whereby to effect rotation of said winch spool by said drive motor, hydraulic supply means for supplying hydraulic fluid to said hydraulic drive motor, said hydraulic supply means comprising an hydraulic pump, and an electric motor for driving said hydraulic pump, and control means for controlling the operation of said electric motor and thus said hydraulic pump, the supply of hydraulic fluid from said hydraulic pump to said hydraulic motor, and said coupling means to control the coupling of said drive motor to said winch spool.

3. A winch assembly as claimed in claim 2 wherein said control means includes control valve means connected between said hydraulic pump and said hydraulic motor.

4. A winch assembly as claimed in claim 3 wherein said control valve means comprises a solenoid operated valve and wherein said control means includes a switch or switches selectively actuable to connect said electric motor and said solenoid valve to a power supply.

5. A winch assembly as claimed in claim 4 wherein said control means include means for delaying the supply of current from said power supply to said electric motor upon actuation of said switch or switches whereby said electric motor commences operation after operation of said solenoid valve.

6. A winch assembly as claimed in claim 4 wherein said control means includes a remote control unit for remotely controlling operation of said switch or switches.

7. A winch assembly as claimed in claim 3 wherein said control means is adapted to cause operation of said hydraulic pump after operation of said control valve means.

8. A winch assembly as claimed in claim 2 wherein said coupling means between said hydraulic drive motor and winch spool prevents disengagement of said hydraulic drive motor from said winch spool when said winch spool is subject to a load.

9. A winch assembly as claimed in claim 8 wherein said coupling means comprises a clutch which when actuated directly couples said hydraulic drive motor to said spool and actuating means for actuating said clutch.

10. A winch assembly as claimed in claim 9 wherein said clutch comprises a dog clutch having complementary clutch members connected to said drive motor and spool respectively.

11. A winch assembly as claimed in claim 10 wherein said complementary clutch members comprise at least one pin or dog provided on a drive plate coupled to said hydraulic motor and at least one complementary aperture provided in a drivable plate connected to or forming part of said spool.

12. A winch assembly as claimed in claim 10 wherein said spool is mounted for movement axially to effect engagement of said clutch members or disengagement of said clutch members.

13. A winch assembly as claimed in claim 12 wherein said clutch-actuating means is operative to move said spool axially to effect engagement of the clutch members.

14. A winch assembly as claimed in claim 13 and including means for causing operation of said clutch actuating means when fluid is supplied from said pump to said hydraulic drive motor whereby to cause coupling of said hydraulic drive motor to said spool through said clutch.

15. A winch assembly as claimed in claim 14 and including one or more hydraulic supply lines between said hydraulic pump and said hydraulic drive motor and wherein said clutch actuating means comprises an hydraulic actuator connected to said one or more hydraulic supply lines whereby fluid is supplied to said hydraulic actuator to cause and maintain coupling between said drive motor and said spool when fluid is supplied to said hydraulic drive motor.

16. A winch assembly as claimed in claim 15 and including further valve means between said control valve means and said drive motor, said further valve means controlling the supply of fluid from said control valve means to said drive motor and exhaustion of fluid from said drive motor to delay operation of said drive motor.

17. A winch assembly as claimed in claim 2 and including braking means associated with said hydraulic motor and operable to brake said hydraulic motor when said hydraulic drive motor is not supplied with fluid.

18. A winch assembly as claimed in claim 2 wherein said control means includes control valve means connected between said pump and said drive motor and wherein said control means include means for delaying operation of said pump and/or supply of fluid to said drive motor until after the operation of said control valve means.

19. A winch assembly comprising:

a support frame, a winch spool mounted for rotation on said support frame, an hydraulic drive motor mounted to said support frame and aligned axially with said winch spool, hydraulically actuable coupling means for coupling said hydraulic drive motor to said winch spool whereby said hydraulic drive motor can rotatably drive said winch spool, an hydraulic pump remote from said hydraulic drive motor for supplying hydraulic fluid to said hydraulic drive motor and said coupling means, an electric motor coupled to said hydraulic pump;

control means for controlling operation of said electric motor and thereby operation of said hydraulic pump to control the supply of hydraulic fluid to said coupling means and thereby the coupling of said hydraulic drive motor to said winch spool and the supply of hydraulic fluid to said hydraulic drive motor for controlling operation of said hydraulic drive motor and thus the rotation of said winch spool.

20. A winch assembly as claimed in claim 19 wherein said winch spool is mounted for axial movement towards and away from said hydraulic motor and wherein said coupling means is operable to move said spool axially towards said hydraulic motor to effect coupling between said hydraulic motor and said winch spool.

21. A winch assembly as claimed in claim 20 wherein said coupling means includes an hydraulic actuator, a pivotally mounted arm connected to said actuator, said arm having a portion cooperable with said spool whereby actuation of said actuator causes pivotal movement of said arm and said axial movement of said spool.

22. A winch assembly as claimed in claim 19 and including at least one fluid supply line between said hydraulic motor and said hydraulic pump and wherein said control means includes a first valve for connecting said fluid supply line to said hydraulic pump and a second valve for connecting said fluid supply line to said hydraulic motor, said second valve delaying the supply of fluid to said hydraulic motor.

23. A winch assembly as claimed in claim 22 wherein said second valve comprises a fluid actuated valve, said valve being actuated when fluid is supplied to said at least one fluid supply line by said first valve.

* * * * *